US012031304B2

(12) United States Patent
Wells et al.

(10) Patent No.: US 12,031,304 B2
(45) Date of Patent: Jul. 9, 2024

(54) CAST TOP COVER FOR BASE EDGE WEAR PROTECTION

(71) Applicant: Caterpillar Inc., Peoria, IL (US)

(72) Inventors: Corey Michael Wells, Peoria, IL (US); Douglas C. Serrurier, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 102 days.

(21) Appl. No.: 17/325,410

(22) Filed: May 20, 2021

(65) Prior Publication Data

US 2022/0372735 A1 Nov. 24, 2022

(51) Int. Cl.
*E02F 9/28* (2006.01)
*E02F 3/815* (2006.01)

(52) U.S. Cl.
CPC ..... *E02F 9/2883* (2013.01); *E02F 3/8152* (2013.01); *E02F 9/28* (2013.01); *E02F 9/2858* (2013.01)

(58) Field of Classification Search
CPC ..... E02F 9/2883; E02F 9/2858; E02F 9/28; E02F 3/8152
See application file for complete search history.

(56) References Cited

U.S. PATENT DOCUMENTS

| | | | | |
|---|---|---|---|---|
| 3,021,626 | A * | 2/1962 | Eyolfson | E02F 3/8152 37/446 |
| 3,368,293 | A * | 2/1968 | Judkins | E02F 9/2841 37/458 |
| 3,997,988 | A * | 12/1976 | Klett | E02F 9/2825 37/456 |
| 8,959,807 | B2 | 2/2015 | LaHood et al. | |
| 9,725,875 | B2 | 8/2017 | Congdon | |
| 10,724,212 | B2 * | 7/2020 | Balan | E02F 9/2825 |
| 2013/0145659 | A1 * | 6/2013 | LaHood | E02F 9/2883 37/453 |
| 2013/0180137 | A1 | 7/2013 | Hurley | |
| 2015/0191899 | A1 | 7/2015 | Jones | |
| 2016/0032556 | A1 * | 2/2016 | Congdon | E02F 3/8152 172/701.3 |
| 2016/0032568 | A1 | 2/2016 | Congdon | |
| 2016/0356024 | A1 | 12/2016 | Gandy | |
| 2020/0362539 | A1 | 11/2020 | Plouzek | |

FOREIGN PATENT DOCUMENTS

| | | |
|---|---|---|
| EA | 7026 | 6/2006 |
| RU | 2669704 | 10/2018 |
| RU | 2681055 | 3/2019 |
| WO | 2005045142 | 5/2005 |

* cited by examiner

*Primary Examiner* — Adam J Behrens
*Assistant Examiner* — Blake E Scoville

(57) ABSTRACT

The top cover defines a first fastener receiving void that is disposed along the direction of material flow between the forward ramp portion and the rear edge. The top male angled surface of the top cover defines a first material flow groove that extends along the direction of material flow, and includes a first flow ramp. The first material flow groove is disposed adjacent along the lateral direction and the direction of material flow to the first fastener receiving void.

20 Claims, 6 Drawing Sheets

CAST TOP COVER FOR BASE EDGE WEAR PROTECTION

TECHNICAL FIELD

The present disclosure relates to work implement assemblies such as bucket assemblies used by earth moving, mining, construction equipment and the like. More specifically, the present disclosure relates to such assemblies that employ components that protect the base edge from wear.

BACKGROUND

Machines such as wheel loaders, excavators, and the like employ work implement assemblies including bucket assemblies, rakes, shears, etc. that have teeth or tips attached to them to help perform work on a material such as dirt, rock, sand, etc. For example, teeth or tips may be attached to a bucket assembly to help the bucket assembly to penetrate the ground, facilitating the scooping of the dirt into a bucket. Adapters are often attached to the work edges (e.g. the base edge, the side edge, etc.) of the bucket or other work implement so that different styles of teeth or tips may be attached to the work implement. Also, the tips or teeth may be replaced easily when worn by providing an adapter that is attached to the work implement. Also, base edge protectors may be attached directly to the base edge to help prevent wear.

However, the base edge protectors themselves may wear over time or might not cover enough of the base edge. So, top covers are sometimes attached to the top of the base edge while a bottom base edge protector is also attached to the bottom of the base edge.

U.S. Pat. No. 8,959,807 disclosed an edge protector or shroud that includes a top leg, a bottom leg, and locking mechanism apertures that extend through the top leg. The top leg may be more prone to wear than the bottom leg, requiring that the entire edge protector be removed even though half or more of the edge protector is still functional. Also, the locking mechanism may be infiltrated by debris in use which may make it harder to remove the edge protector.

Accordingly, a top cover for protecting the base edge that has improved longevity and that may be more reliably installed and removed is warranted.

SUMMARY OF THE DISCLOSURE

A top cover for protecting a base edge according to an embodiment of the present disclosure may comprise a rear attachment portion defining a first fastener receiving void, a vertical direction of assembly, a lateral direction that is perpendicular to the vertical direction of assembly, and a direction of material flow that is perpendicular to the vertical direction of assembly and the lateral direction. The top cover may include a rear edge disposed along the direction of material flow, a forward ramp portion that extends forwardly from the rear attachment portion along the direction of material flow, and vertically downwardly forming a front wear edge, a top male angled surface that extends from the rear edge to the front wear edge, and a bottom female angled surface that extends from the rear edge to the front wear edge. The first fastener receiving void may be disposed along the direction of material flow between the forward ramp portion and the rear edge, and the top male angled surface may define a first material flow groove that extends along the direction of material flow, and includes a first flow ramp. The first material flow groove may be disposed adjacent along the lateral direction and the direction of material flow to the first fastener receiving void.

A top cover for protecting a base edge according to another embodiment of the present disclosure may comprise a rear attachment portion defining a first fastener receiving void, a vertical direction of assembly, a lateral direction that is perpendicular to the vertical direction of assembly, and a direction of material flow that is perpendicular to the vertical direction of assembly and the lateral direction. The top cover may include a rear edge disposed along the direction of material flow, a forward ramp portion that extends forwardly from the rear attachment portion along the direction of material flow, and vertically downwardly forming a front wear edge, a top male angled surface that extends from the rear edge to the front wear edge, and a bottom female angled surface that extends from the rear edge to the front wear edge. Also, a first lateral outside edge may extend from the rear edge to the front wear edge, as well as a second lateral outside edge extending from the rear edge to the front wear edge. The top male angled surface may define a first cutout region that extends from adjacent the front wear edge to the first lateral outside edge, and a second cutout region that extends from adjacent the front wear edge to the second lateral outside edge.

A top cover for protecting a base edge according to yet another embodiment of the present disclosure may comprise a rear attachment portion defining a first fastener receiving void, a vertical direction of assembly, a lateral direction that is perpendicular to the vertical direction of assembly, and a direction of material flow that is perpendicular to the vertical direction of assembly and the lateral direction. The top cover may include a rear edge disposed along the direction of material flow, a forward ramp portion that extends forwardly from the rear attachment portion along the direction of material flow, and vertically downwardly forming a front wear edge, a top male angled surface that extends from the rear edge to the front wear edge, a bottom female angled surface that extends from the rear edge to the front wear edge, a first lateral outside edge extending from the rear edge to the front wear edge, and a second lateral outside edge extending from the rear edge to the front wear edge. The bottom female angled surface may include a plurality of fitting pads, a plurality of recesses, and a relief cutout joining the rear attachment portion to the forward ramp portion.

DETAILED DESCRIPTION

Figure 1:
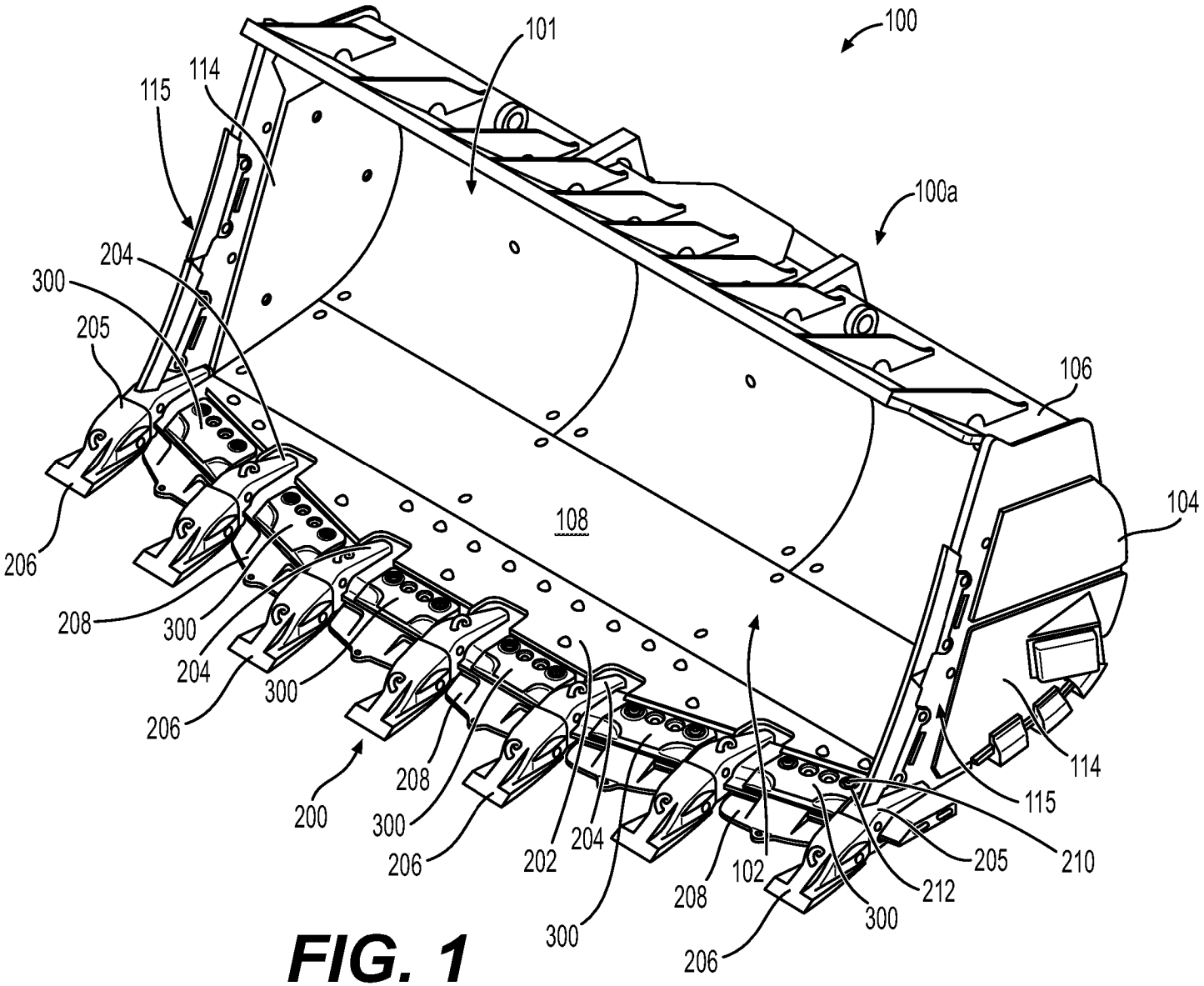
FIG. 1 is a perspective view of a work implement assembly such as a bucket assembly using top cast covers on base edge protectors according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function such as is often the case when geometry is mirrored about a plane of symmetry. For ease of explanation in this specification, letters or primes will often not be included herein but may be shown in the drawings to indicate duplications of features discussed within this written specification.

A cast top cover according to various embodiments of the present disclosure will be described momentarily that are provided for base edge wear protection of a bucket assembly or other type of work implement assembly. The cast cover may have certain features to promote even wearing of the part throughout its useful life as well as raised surfaces for bolt and nut protection to aid in removal of part at end of life, angled ramps at the front and rear to promote material flow away from the bolts and nuts, bevel relief for correct fitment, in some cases a middle ramp may be omitted to aid in manufacturing and to allow a designated area for a riser used in the casting process, fit pads to ensure correct fitment, cutouts in the bottom of the part for weight reduction and improved manufacturability, etc. It is to be understood that other manufacturing processes in addition to, or in lieu of casting, may be used such as various forms of forging, machining, etc.

Starting with FIG. 1, the work implement assembly 100 may take the form of a bucket assembly 100*a* that includes an enclosure 101 that defines an opening 102 that communicates with a generally enclosed interior. Starting from the rear of the bucket assembly 100*a*, the bucket assembly 100*a* includes a curved shell profile 104, which is attached to a top wall 106 at the top end of the shell 104. The other end of the shell is attached to the bottom plate 108 of the assembly 100. Two substantially flat end plates 114 are attached to the side edges of the top plate 106, bottom plate 108 and shell 104.

A side edge assembly 115 is attached to each end plate 114 while a front edge assembly 200 is attached to the front edge of the bottom plate 108 of the bucket assembly 100. The front edge assembly 200 includes a base edge 202 (may also be referred to as a front lip), a plurality of center adapters 204 attached to the base edge 202, a pair of corner adapters 205 attached to the base edge and the end plate(s), and a plurality of tips 206 or teeth attached to the adapters, a plurality of bottom edge protectors 208 extending from the underside of the base edge 202, and a plurality of top covers 300 that contact or nearly contact the bottom edge protectors to help provide the desired base edge protection. The bottom edge protectors and the top covers are bolted to the base edge using a bolt 210 and nut 212. The free end of the bolt and the nut are shown in FIG. 1, while the head of the bolt is not shown being on the underside of the bucket assembly.

It is to be understood the work implement assembly may take other forms other than a bucket assembly including rake assemblies, shear assemblies, etc. Also, any of the embodiments of the cutting edge tips may be used in any of these other forms of work implement assemblies including other differently configured bucket assemblies.

First, a top cover that may have a reduced weight and promote material flow into and out of the work implement assembly will be discussed.

Such a top cover 300, 400, 500, 600 may be seen in FIGS. 2, and 4 thru 6. The top cover 300, 400, 500, 600 may comprise a rear attachment portion 302, 402, 502, 602 defining a first fastener receiving void 304, 404, 504, 604, and a vertical direction of assembly 306, 406, 506, 606 (so called since the void 304 may define a cylindrical axis along which a bolt is vertically inserted for assembly). Also, a lateral direction 308, 408, 508, 608 that is perpendicular to the vertical direction of assembly, and a direction of material flow 310, 410, 510, 610 that is perpendicular to the vertical direction of assembly, and the lateral direction. The direction of material flow is so called since this is the direction along which material generally enters or exits the bucket or other work implement.

The top cover 300, 400, 500, 600 also may include a rear edge 312, 412, 512, 612 that is disposed along the direction of material flow 310, 410, 510, 610, and a forward ramp portion 314, 414, 514, 614 that extends forwardly from the rear attachment portion 302, 402, 502, 602 along the direction of material flow, and vertically downwardly forming a front wear edge 316, 416, 516, 616.

Complementarily shaped surfaces may define the general thickness of the top cover. For example, a top male angled surface 318, 418, 518, 618 may extend from the rear edge 312, 412, 512, 612 to the front wear edge 314, 414, 514, 614, while a bottom female angled surface 320, 420, 520, 620 may extend from the rear edge 312, 412, 512, 612 to the front wear edge 314, 414, 514, 614.

The first fastener receiving void 304, 404, 504, 604 may be disposed along the direction of material flow 310, 410, 510, 610 between the forward ramp portion 314, 414, 514, 614 and the rear edge 312, 412, 512, 612, and the top male angled surface 318, 418, 518, 618 may define a first material flow groove 322, 422, 522, 622 that extends along the direction of material flow 310, etc. (this is the direction of greatest extent for the flow groove). The first material flow groove may include a first flow ramp 324, 424, 524, 624. Also, the first material flow groove 322, 422, 522, 622 may be disposed adjacent along the lateral direction 308, 408, 508, 608 and the direction of material flow 310, 410, 510, 610 to the first fastener receiving void 304, 404, 504, 604 (e.g., may be diagonally placed relative to the void). This may help to steer material away from the void, while also reducing weight and cost of the top cover.

In addition, a first lateral outside edge 326, 426, 526, 626 may extend from the rear edge 312, 412, 512, 612 to the front wear edge 316, 416, 516, 616, and a second lateral outside edge 328, 428, 528, 628 may extend from the rear edge to the front wear edge. In some cases, the first fastener receiving void 304, 404, 504, 604 is disposed proximate to the first lateral outside edge 326, 426, 526, 626 and the rear edge 312, 412, 512, 612 (e.g., near a corner). Other placements are possible in other embodiments of the present disclosure. Also, this void 304, 404, 504, 604 may be surrounded by a projection 330, 430, 530, 630 that defines a counterbore 332, 432, 532, 632. So, the free end of the bolt and the nut may be recessed relative to the top surface of the top cover, helping to minimize the ingress of dirt and debris as well as wear, etc.

The projection may include a first sloping surface 334, 434, 534, 634 that extends along the direction of material flow 310, 410, 510, 610 from adjacent the forward ramp portion 314, 414, 514, 614 toward the counterbore 332, 432, 532, 632. The projection 330, 430, 530, 630 may at least partially define the first material flow groove 322, 422, 522, 622. Also, the first sloping surface 334, 434, 534, 634 may be disposed laterally adjacent to the first material flow groove 322, 422, 522, 622. Other arrangements are possible in other embodiments of the present disclosure.

Similarly, the projection 330, 430, 530, 630 may include a second sloping surface 336, 436, 536, 636 that extends from adjacent the rear edge 312, 412, 512, 612 along the direction of material flow 310, 410, 510, 610 toward the counterbore 332, 432, 532, 632. This may not be the case for other embodiments of the present disclosure. The first and the second sloping surfaces may be laterally aligned with each other as shown, but not necessarily so.

With continued reference to FIGS. 2, and 4 thru 6, the top male angled surface 318, 418, 518, 618 may define a second material flow groove 338, 438, 538, 638 that extends along the direction of material flow 310, 410, 510, 610 from adjacent the rear edge 312, 412, 512, 612 toward the first material flow groove 322, 422, 522, 622, and may include a second flow ramp 340, 440, 540, 640 at the bottom of the flow groove. In some cases, the second material flow groove 338, 438, 538, 638 may be laterally aligned with the first material flow groove 322, 422, 522, 622, but not necessarily so. This alignment may help material to flow past the counterbores.

Figure 4:
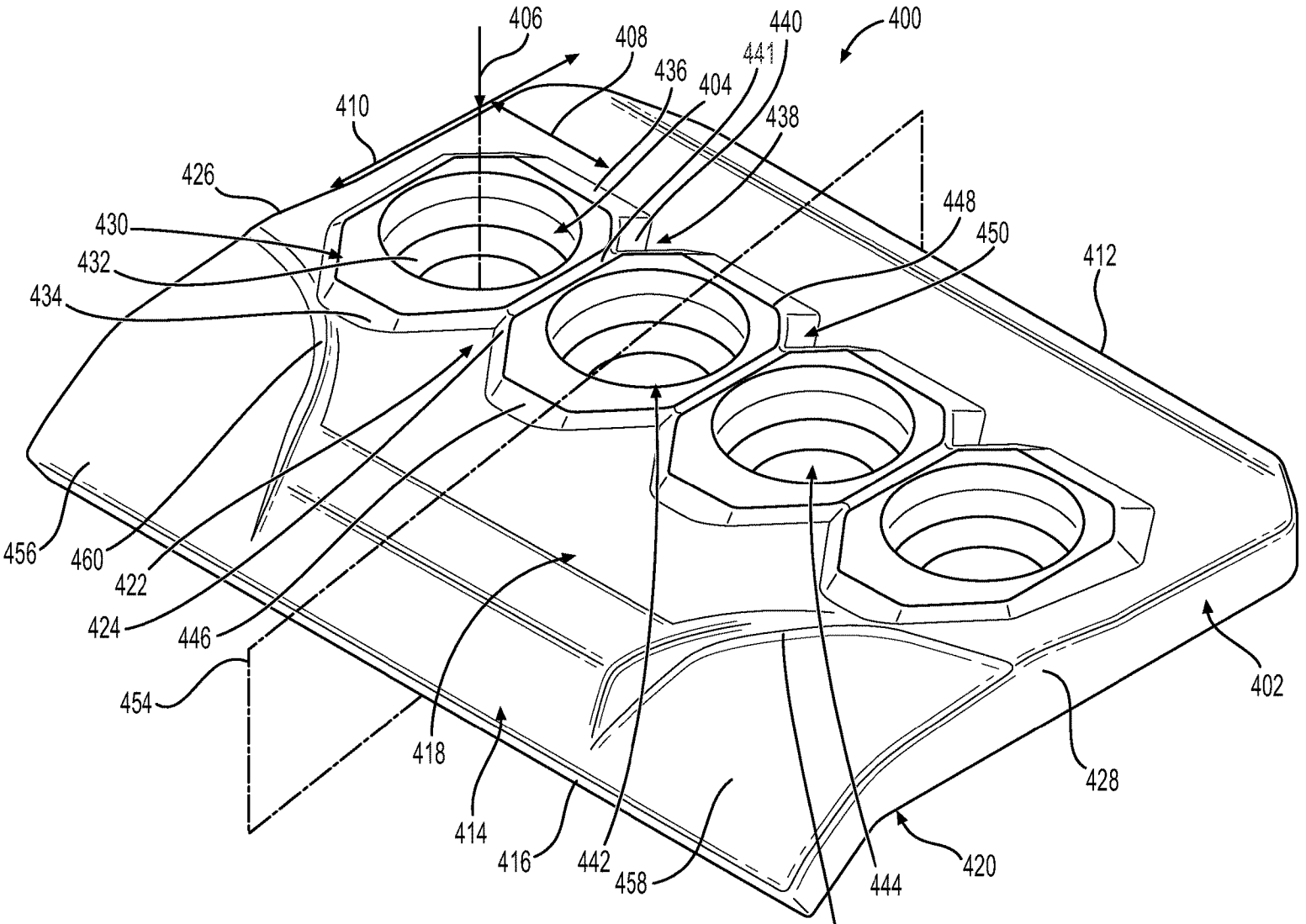
FIG. 4 is a top perspective view of a second embodiment of a top cast cover.
Figure 5:
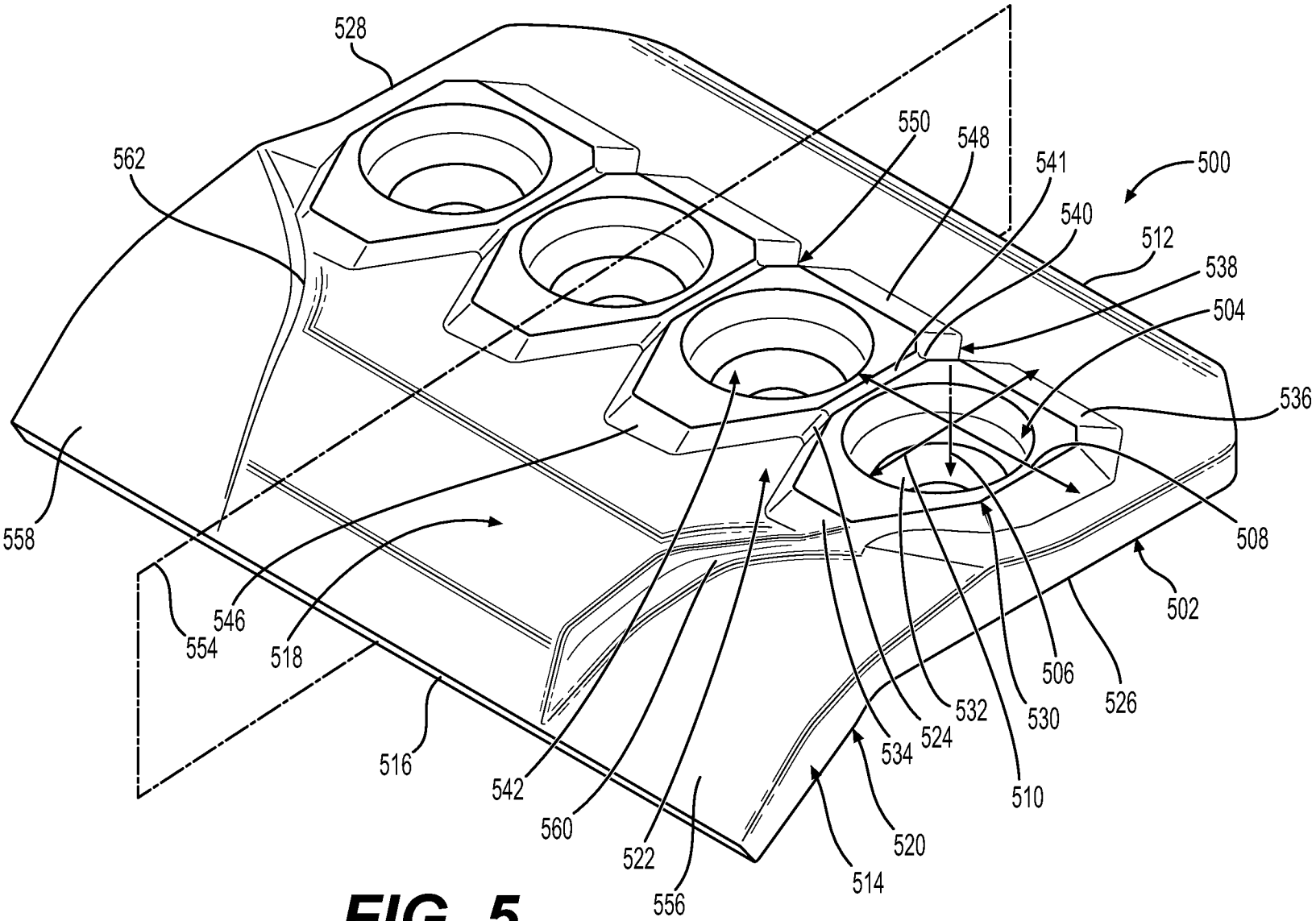
FIG. 5 is a top perspective view of a third embodiment of a top cast cover.

In FIGS. 4 and 5, the first material flow groove 422, 522, and the second material flow groove 438, 538 are connected by a channel 441, 541 that extends along the direction of material flow 410, 510. A pair of fastener receiving voids may straddle this channel.

Referring again to FIGS. 2, and 4 thru 6, the top cover 300, 400, 500, 600 may define a second fastener receiving void 342, 442, 542, 642, and a third fastener receiving void 344, 444, 544, 644. A third sloping surface 346, 446, 546, 646 may be disposed in front of the second fastener receiving void 342, 442, 542, 642 along the direction of material flow and the lateral direction. A fourth sloping surface 348, 448, 548, 648 may be disposed to the rear of the second fastener receiving void 342, 442, 542, 642 along the direction of material flow 310, 410, 510, 610. The third sloping surface 346, 446, 546, 646 may be disposed laterally adjacent to the first material flow groove 322, 422, 522, 622, while the fourth sloping surface 348, 448, 548, 648 may be disposed laterally adjacent to the second material flow groove 338, 438, 538, 638. Also, the fourth sloping surface 348, 448, 548, 648 may be disposed laterally adjacent a third material flow groove 350, 450, 550, 650 that is disposed laterally between the second fastener receiving void 342, 442, 542, 642, and the third fastener receiving void 344, 444, 544, 644.

Figure 2:
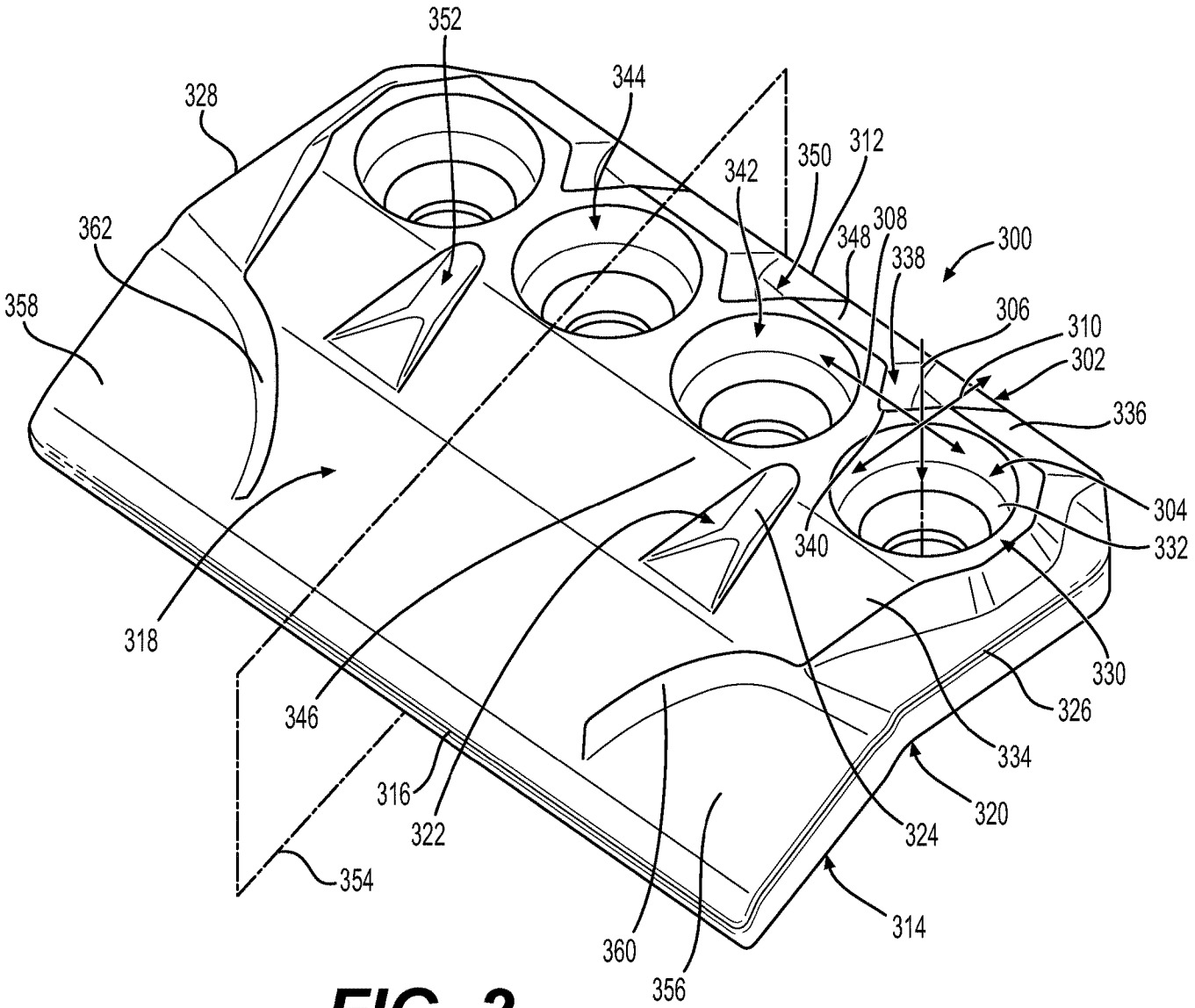
FIG. 2 is a top perspective view of a top cast cover according to a first embodiment of the present disclosure that may be used on the bucket assembly of FIG. 1.
Figure 6:
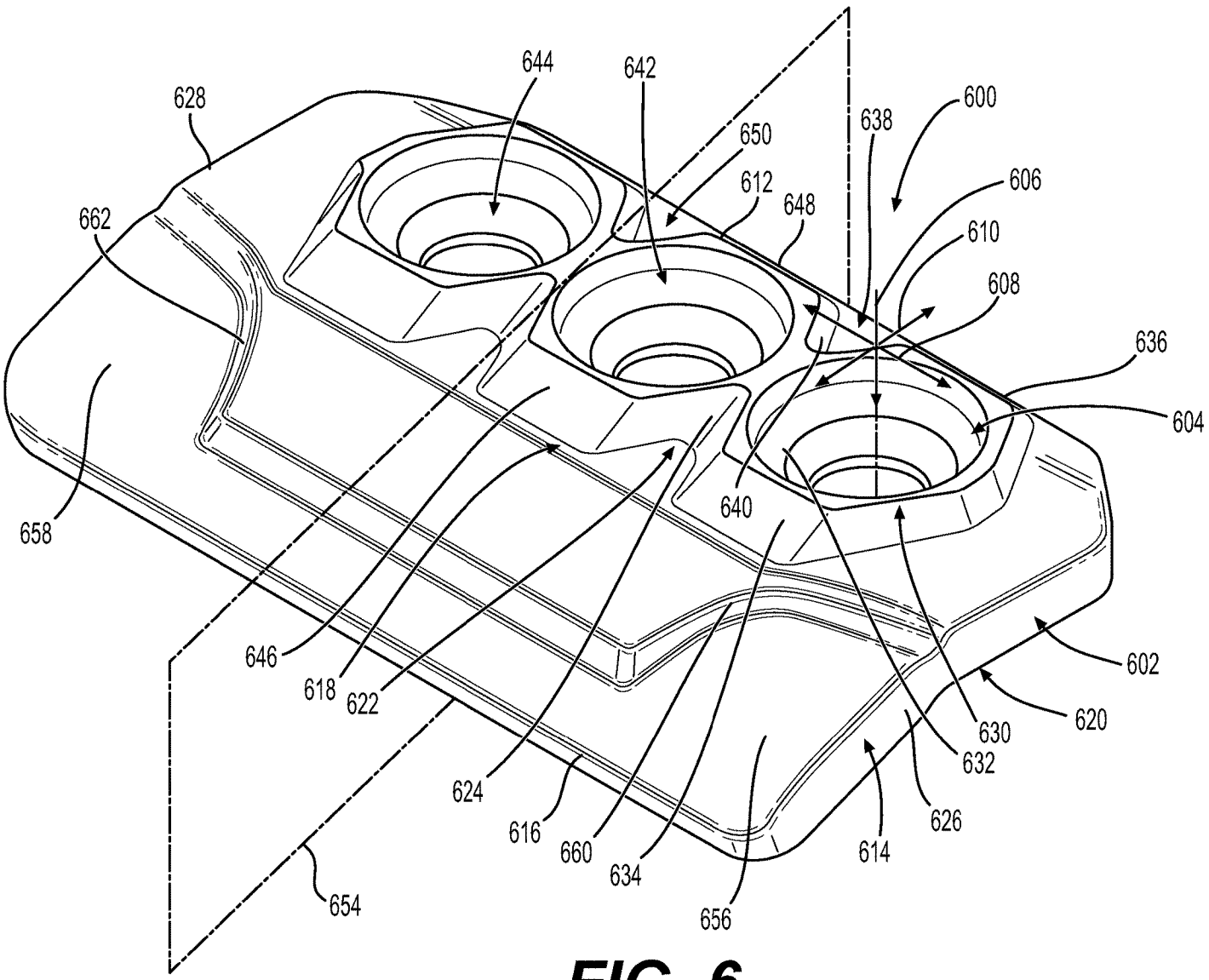
FIG. 6 is a top perspective view of a fourth embodiment of a top cast cover.

In FIG. 2, the third sloping surface 346 extends laterally in front of the third fastener receiving void 344 to a fourth material flow groove 352 that is symmetrical to the first material flow groove 352 about a midplane 354. This larger sloping surface 346 may ease manufacture by providing a riser location during the casting process. This may not be the case in other embodiments such as shown in FIGS. 4 thru 6.

In general, top cover 300, 400, 500, 600 and all of its associated features including those on top and on bottom may be symmetrical about the midplane 354, 454, 554, 654. This may not be true in other embodiments of the present disclosure.

Next, a top cover that has reduced weight and that may also wear more evenly will be discussed referring still to FIGS. 2, 4 thru 6.

The top male angled surface 318, 418, 518, 618, defines a first cutout region 356, 456, 556, 656 that extends from adjacent the front wear edge 316, 416, 516, 616 to the first lateral outside edge 326, 426, 526, 626, and a second cutout region 358, 458, 558, 658 that extends from adjacent the front wear edge 316, 416, 516, 616 to the second lateral outside edge 326, 426, 526, 626.

Weight reduction in these areas is based on material flow from wear simulations to provide even wear throughout the useful life of the part. To that end, the first cutout region 356, 456, 556, 656 may include a first concave arcuate flow surface 360, 460, 560, 660 that extends from adjacent the front wear edge 316, 416, 516, 616 to the first lateral outside edge 326, 426, 526, 626 to help direct material during use. Similarly, the second cutout region 358, 458, 558, 658 may include a second concave arcuate flow surface 362, 462, 562, 662 that extends from adjacent the front wear edge, splines, polynomials, ellipse(s), etc. 316, 416, 516, 616 to the second lateral outside edge 326, 426, 526, 626 for the same purpose.

As used herein, the term "arcuate" may include any bowed shape including those formed by various geometric entities including, but not limited to, radius or a series of radii, splines, polynomials, ellipse(s), etc.

Figure 3:
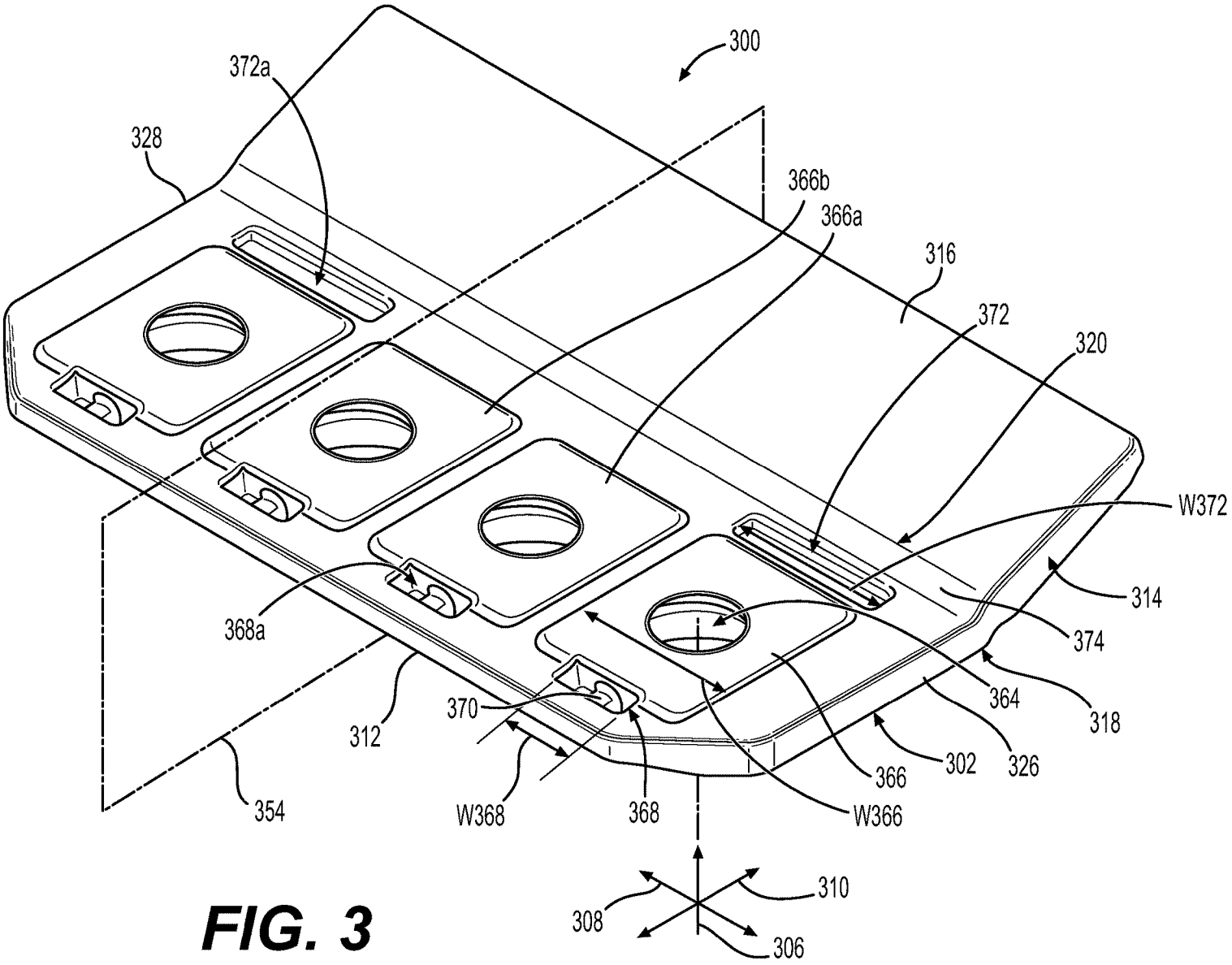
FIG. 3 is a bottom perspective view of the top cast cover of FIG. 2.

Looking now at FIG. 3, it can be seen that the bottom female angled surface defines 320 a first fastener receiving hole 364 extending vertically through the rear attachment portion 302 (may be in communication with the first fastener receiving void 304), and includes a first rectangularly shaped fit pad 366 centered about the first fastener receiving hole 362.

Also, the bottom female angled surface 320 may further define a first rectangularly shaped recess 368 that is disposed proximate to the rear edge 312, and the first rectangularly shaped fit pad 366 along the direction of material flow 310. This recess 368 may be centered with the first rectangularly shaped fit pad 366 along the lateral direction 308.

As shown in FIG. 3, the first rectangularly shaped recess 368 may carve out a portion of the first rectangularly shaped fit pad 366, but not necessarily so. In addition, the first rectangularly shaped recess 368 may surround a boss 370 (may also be referred to as a rib) extending from a bottom surface of the first rectangularly shaped recess 368. This may not be the case for other embodiments of the present disclosure.

Also, the bottom female angled surface 320 may further define a second rectangularly shaped recess 372 that is disposed between the forward ramp portion 314, and the first rectangularly shaped fit pad 366 along the direction of material flow 310. This recess 372 may also be centered with the first rectangularly shaped fit pad 366 along the lateral direction 308, but not necessarily so.

These recesses 368, 372 may be shaped to reduce weight and cost, while also not compromising the strength of the top cover. So, the first rectangularly shaped recess 368 may define a first recess lateral width W368, the second rectangularly shaped recess 372 may define a second recess lateral width W372, and the first rectangularly shaped fit pad 366 may define a pad lateral width W366. A ratio of the first recess lateral width W368 to the pad lateral width W66 may range from 0.35 to 0.75, and a ratio of the second recess lateral width W372 to the pad lateral width W366 may range from 0.95 to 1.05. Other ratios and ranges are possible in other embodiments of the present disclosure.

It is to be understood that the underside or bottom female angled surface 420, 520, 620 of the top covers 400, 500, 600 of FIGS. 4 thru 6 may be similarly or identically configured to that of FIG. 3, except some instances of the fit pad, the first rectangularly shaped recess, the second rectangularly shaped recess, and the fastener receiving hole may be added or omitted. Also, the ratios just mentioned be adjusted based on the size of the top cover, etc.

With continued reference to FIG. 3, the underside of the top cover 300 and its features may be characterized as follows. The bottom female angled surface 320 may include a plurality of fitting pads (e.g. see 366), a plurality of recesses (e.g. see 368, 372), and a relief cutout 374 joining the rear attachment portion 302 to the forward ramp portion 314.

The plurality of fitting pads may be arranged in a first linear array (e.g., there may be 3 or 4 instances) of rectangularly shaped fitting pads 366, 366*a*, 366*b* that are arranged along the lateral direction 308 on the rear attachment portion 302.

Likewise, the plurality of recesses may be arranged in a second linear array (e.g., see 368, 368*a*) on the rear attachment portion 302, and a third linear array (e.g., see 372, 372*a*) on the rear attachment portion 302 that is spaced away from the first linear array along the direction of material flow 310 with the plurality of fitting pads (e.g., see 366) interposed between the first linear array and the second linear array along the direction of material flow 310.

More specifically, the second linear array may include a pair of the plurality of recesses (e.g., see 368), and the second linear array includes four of the plurality of recesses (e.g., see 372). A plurality of apertures (e.g., see 364) that extend vertically through the plurality of fitting pads, being centered on the plurality of fitting pads to provide a stable interface during the fastening process. Other arrangements are possible in other embodiments of the present disclosure.

Again, it should be noted that any of the dimensions, angles, surface areas and/or configurations of various features may be varied as desired or needed including those not specifically mentioned herein. Although not specifically discussed, blends such as fillets are shown to connect the various surfaces. These may be omitted in other embodiments and it is to be understood that their presence may be ignored sometimes when reading the present specification unless specifically mentioned.

INDUSTRIAL APPLICABILITY

In practice, a machine, a work implement assembly, a front edge assembly, a top cover, or any component thereof may be manufactured, bought, or sold to retrofit a machine or a work implement assembly in the field in an aftermarket context, or alternatively, may be manufactured, bought, sold or otherwise obtained in an OEM (original equipment manufacturer) context.

Any of the aforementioned components including the top cover may be made from any suitable material including iron, grey-cast iron, steel, etc.

The top cover may be manufactured via a casting process with material allocated to the center of the part for even wear throughout the useful life of the part. Raised surfaces for bolt and nut protection are provided to aid in removal of part at the end of its useful life. Angled ramps at the front and rear may also be provide to promote material flow away from the bolts and nuts. As discussed previously, center material flow grooves and their associated flow ramps may be omitted in some embodiments to aid in manufacturing via a casting process, and to allow a designated area for a riser. A bevel relief may be provided for correct fitment to a base edge. Fit pads may also be provided to ensure correct fitment to a base edge. Cutouts or recesses may be provided in the bottom of the part for weight reduction and improved manufacturability. For example, thick sections of material may be decreased, reducing the risk of voids, porosity, etc. occurring during the casting process.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A top cover for protecting a base edge comprising:

a rear attachment portion defining:

a first fastener receiving void, a second fastener receiving void, a third fastener receiving void, a vertical direction of assembly, a lateral direction that is perpendicular to the vertical direction of assembly, and a direction of material flow that is perpendicular to the vertical direction of assembly and the lateral direction, the rear attachment portion including a rear edge disposed along the direction of material flow;

a forward ramp portion that extends:

forwardly from the rear attachment portion along the direction of material flow, and vertically downwardly forming a front wear edge;

a top male angled surface that extends from the rear edge to the front wear edge; and a bottom female angled surface that extends from the rear edge to the front wear edge, wherein the first fastener receiving void is disposed along the direction of material flow between the forward ramp portion and the rear edge, and wherein the top male angled surface defines:

a first material flow groove that extends along the direction of material flow, a second material flow groove, and a sloping surface that is disposed in front of the second fastener receiving void along the direction of material flow and is disposed laterally adjacent to the first material flow groove, wherein a different sloping surface is disposed to rear of the second fastener receiving void along the direction of material flow, wherein the different sloping surface is disposed laterally adjacent to the second material flow groove, wherein the different sloping surface is disposed laterally adjacent a third material flow groove that is disposed laterally between the second fastener receiving void and the third fastener receiving void, and wherein the first material flow groove includes a flow ramp.

2. The top cover of claim 1, further comprising:

a first lateral outside edge extending from the rear edge to the front wear edge, and a second lateral outside edge extending from the rear edge to the front wear edge, wherein the first fastener receiving void is disposed proximate to the first lateral outside edge and the rear edge, and wherein the first fastener receiving void is surrounded by a projection that defines a counterbore.

3. The top cover of claim 2, wherein the projection includes another sloping surface that extends along the direction of material flow from adjacent the forward ramp portion toward the counterbore, and wherein the projection at least partially defines the first material flow groove.

4. The top cover of claim 2, wherein the projection includes another sloping surface that extends from adjacent the rear edge along the direction of material flow toward the counterbore.

5. The top cover of claim 1, wherein the flow ramp is a first flow ramp, wherein the second material flow groove extends along the direction of material flow from adjacent the rear edge toward the first material flow groove, and wherein the second material flow groove includes a second flow ramp, the second material flow groove being laterally aligned with the first material flow groove.

6. The top cover of claim 1, wherein the first material flow groove and the second material flow groove are connected by a channel that extends along the direction of material flow.

7. The top cover of claim 1, wherein the sloping surface extends laterally in front of the third fastener receiving void to a fourth material flow groove that is symmetrical to the first material flow groove about a midplane.

8. A work implement assembly, comprising:

a shell;

a top plate at a first end of the shell;

a bottom plate at a second end of the shell;

a front edge assembly attached to an edge of the bottom plate; and a plurality of top covers attached to a base edge of the front edge assembly, a top cover, of the plurality of top covers, comprising:

a rear attachment portion defining:

a first fastener receiving void, a second fastener receiving void, a third fastener receiving void, a vertical direction of assembly, a lateral direction that is perpendicular to the vertical direction of assembly, and a direction of material flow that is perpendicular to the vertical direction of assembly and the lateral direction, the rear attachment portion including a rear edge disposed along the direction of material flow;

a forward ramp portion that extends:

forwardly from the rear attachment portion along the direction of material flow, and vertically downwardly forming a front wear edge;

a top male angled surface that extends from the rear edge to the front wear edge; and a bottom female angled surface that extends from the rear edge to the front wear edge, the first fastener receiving void being disposed along the direction of material flow between the forward ramp portion and the rear edge, and the top male angled surface defining:

a first material flow groove that extends along the direction of material flow, a second material flow groove, and a sloping surface that is disposed in front of the second fastener receiving void and is disposed laterally adjacent to the first material flow groove, a different sloping surface being disposed to rear of the second fastener receiving void along the direction of material flow, the different sloping surface being disposed laterally adjacent to the second material flow groove, the different sloping surface being disposed laterally adjacent a third material flow groove that is disposed laterally between the second fastener receiving void and the third fastener receiving void, and the first material flow groove including a flow ramp.

9. The work implement assembly of claim 8, further comprising:

a first lateral outside edge extending from the rear edge to the front wear edge, and a second lateral outside edge extending from the rear edge to the front wear edge, wherein the first fastener receiving void is disposed proximate to the first lateral outside edge and the rear edge.

10. The work implement assembly of claim 8, wherein the first fastener receiving void is surrounded by a projection that defines a counterbore.

11. The work implement assembly of claim 10, wherein the projection includes another sloping surface.

12. The work implement assembly of claim 10, wherein the projection includes another sloping surface that is disposed laterally adjacent to the first material flow groove.

13. The work implement assembly of claim 10, wherein the projection at least partially defines the first material flow groove.

14. The work implement assembly of claim 10, wherein the projection includes another sloping surface that extends from adjacent the rear edge along the direction of material flow toward the counterbore.

15. The work implement assembly of claim 8,
wherein the flow ramp is a first flow ramp,
wherein the second material flow groove extends along the direction of material flow from adjacent the rear edge toward the first material flow groove, and
wherein the second material flow groove includes a second flow ramp.

16. The work implement assembly of claim 15, wherein the second material flow groove is laterally aligned with the first material flow groove.

17. The work implement assembly of claim 8,
wherein the first material flow groove and the second material flow groove are connected by a channel.

18. The work implement assembly of claim 8, wherein the top cover is attached to the base edge by being bolted to the base edge using a bolt.

19. The work implement assembly of claim 18, wherein the top cover is bolted to the base edge further using a nut.

20. The work implement assembly of claim 8,
wherein the front edge assembly comprises:
a plurality of center adapters attached to the base edge,
a plurality of tips or teeth connected to the plurality of center adapters, and
a plurality of bottom edge protectors extending from an underside of the base edge, and
wherein the plurality of bottom edge protectors are in contact or adjacent to the plurality of top covers.

* * * * *